US008695723B2

(12) United States Patent
Werner et al.

(10) Patent No.: US 8,695,723 B2
(45) Date of Patent: Apr. 15, 2014

(54) HAMMER DRILL AND/OR CHISEL HAMMER

(75) Inventors: Immanuel Werner, St. Johann (DE); Harald Schindler, Stuttgart (DE); Gerhard Meixner, Filderstadt (DE); Juergen Schlipf, Leonberg (DE); Stefan Holst, Ulm (DE); Andreas Strasser, Rudersberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/994,676

(22) PCT Filed: Nov. 19, 2008

(86) PCT No.: PCT/EP2008/065788
§ 371 (c)(1),
(2), (4) Date: Nov. 24, 2010

(87) PCT Pub. No.: WO2009/143906
PCT Pub. Date: Dec. 3, 2009

(65) Prior Publication Data

US 2011/0073339 A1 Mar. 31, 2011

(30) Foreign Application Priority Data

May 26, 2008 (DE) ..... 10 2008 001 957

(51) Int. Cl.
*B25D 17/24* (2006.01)

(52) U.S. Cl.
USPC ..... 173/162.1; 173/162.2; 173/210; 173/211

(58) Field of Classification Search
USPC ..... 173/162.1, 162.2, 210–211, 90
See application file for complete search history.

(56) References Cited

U.S. PATENT DOCUMENTS

| | | | | |
|---|---|---|---|---|
| 1,414,234 | A * | 4/1922 | Tuttle | 279/19.1 |
| 1,592,858 | A | 7/1926 | Lear | |
| 1,656,301 | A * | 1/1928 | Stevens | 173/162.2 |
| 1,777,305 | A | 10/1930 | Hansen | |
| 1,888,333 | A * | 11/1932 | Terry | 173/162.2 |
| 2,558,165 | A | 6/1951 | Anderson | |
| 3,451,492 | A | 6/1969 | Ekstroem et al. | |
| 4,371,043 | A * | 2/1983 | Kubokawa | 173/162.2 |
| 7,819,203 | B2 * | 10/2010 | Sato et al. | 173/210 |
| 2005/0269117 | A1 * | 12/2005 | Sato et al. | 173/132 |

FOREIGN PATENT DOCUMENTS

| | | | |
|---|---|---|---|
| BE | 524086 | A | 11/1953 |
| DE | 1300475 | B | 7/1969 |
| DE | 6950059 | U | 6/1971 |
| DE | 120611 | A1 | 6/1976 |
| GB | 2234464 | A | 2/1991 |
| HU | 185749 | B | 3/1985 |

* cited by examiner

*Primary Examiner* — Michelle Lopez
(74) *Attorney, Agent, or Firm* — Maginot, Moore & Beck

(57) ABSTRACT

The invention is based on a hammer drill and/or chisel hammer, having an impact mechanism unit, an impact mechanism housing and at least one damping unit. The invention proposes that the damping unit is arranged on the impact mechanism housing along a main extension direction of the impact mechanism unit.

12 Claims, 4 Drawing Sheets

HAMMER DRILL AND/OR CHISEL HAMMER

CROSS-REFERENCE TO RELATED APPLICATION

This application is a 35 USC 371 application of PCT/EP 2008/065788 filed on Nov. 19, 2008.

BACKGROUND OF THE INVENTION

1. Field of the Invention

The invention is based on a hammer drill and/or chisel hammer.

2. Description of the Prior Art

There are already known hammer drills and/or chisel hammers that have an impact mechanism device, an impact mechanism housing, and a damping device.

SUMMARY OF THE INVENTION

The invention is based on a hammer drill and/or chisel hammer that has an impact mechanism device, an impact mechanism housing, and at least one damping device.

According to one proposal, the damping device is situated along a main extension direction of the impact mechanism device on the impact mechanism housing. The term "impact mechanism device" here should in particular be understood to be a device that has at least one component that is provided to produce and/or transmit an impulse, in particular an axial hammering impulse, to a tool. In particular, such a component can be an impact element, a hammer tube, a piston—in particular a pot piston, and/or a striking element, and/or other components deemed suitable by the person skilled in the art. An impact element of the impact mechanism device is preferably embodied in the form of an impact pin or impact die, which advantageously constitutes an impact element that is separate from a striking element and in particular, during operation of the hammer drill and/or chisel hammer, comes into direct contact with a tool in order to transmit impulses. The term "impact mechanism housing" here should in particular define a housing that is in particular situated in a region of the impact mechanism device, particularly preferably in a region of a guide element for guiding a striking element. The impact mechanism housing is advantageously situated in a circumference direction around at least a partial region of the impact mechanism device, e.g. around the striking element and/or in particular around the guide element for guiding the striking element. The impact mechanism housing can also be advantageously embodied to be at least partially of one piece with the impact mechanism device, in particular the impact mechanism housing can be at least partially of one piece with a hammer tube and/or a guide tube for guiding a piston, in particular a pot piston. The impact mechanism housing can be embodied as a separate housing that can be detached from a motor housing. It is also possible, however, to embody the impact mechanism housing to be of one piece with the motor housing. It is also possible to provide other variants of the impact mechanism housing deemed suitable by the person skilled in the art such as a two-part impact mechanism housing. Preferably, the guide element is constituted by a tubular or cylindrical element that is provided to guide the striking element axially along the main extension direction of the impact mechanism device. In addition, the guide element can be embodied in a particularly advantageous way to be of one piece with the piston, e.g. the pot piston, and/or it can be embodied to be of one piece with the hammer tube. The striking element can thus move in the axial direction inside the guide element. The expression "on the impact mechanism housing" here should in particular be understood to mean a placement of a damping device in an axial region of the impact mechanism housing; the term "axial region" should in particular be understood to be a region along which the impact mechanism housing extends in an axial direction with a main extension direction of the impact mechanism housing, which is oriented essentially parallel to a main impulse transmission direction of the impact mechanism device, and/or a region that essentially borders a piston, in particular a pot piston, and/or a hammer tube. Preferably, a circumference surface of the impact mechanism housing extends along the axial region. Advantageously, at least 50% of the damping device, particularly advantageously at least 70% of it, and particularly preferably at least 85% of it, is situated along the main extension direction of the impact mechanism device along the axial region. The term "damping device" here should in particular be understood to be a device that includes at least one component that is preferably provided to reduce a transmission of a hammering impulse of an impact element and/or a striking element to a housing and/or to at least one component associated with the housing. The damping device in this case advantageously serves at least partially to insulate vibration and/or to damp vibration of the housing and/or of the at least one component associated with the housing. The damping device can also include components that are provided alternatively or in addition for guiding and/or supporting and/or fastening. In this context, "provided" should in particular be understood to mean specially equipped and/or specially designed. The "main extension direction of the impact mechanism device" defines a direction that extends essentially parallel to a maximum axial longitudinal span of the impact mechanism device, in particular the guide element, and in particular, is oriented parallel to an impulse transmission direction inside the impact mechanism device. The hammer drill and/or chisel hammer is preferably embodied in the form of a demolition hammer.

The embodiment of the hammer drill and/or chisel hammer according to the invention can advantageously achieve a high degree of operator convenience. An operator of the hammer drill and/or chisel hammer can conveniently actuate a retaining bracket provided to radially lock a tool in a tool holder of the hammer drill and/or chisel hammer. In addition, it is possible to achieve the advantage that the hammer drill and/or chisel hammer can be compactly embodied, making it possible to achieve an advantageous maneuvering in hard-to-access locations to be machined. In addition, it is possible to save on components and to minimize the costs of the hammer drill and/or chisel hammer. In addition, the damping device can advantageously be at least partially protected through the placement on the impact mechanism housing.

According to another proposal, the impact mechanism housing has at least one recess and the damping device is at least partially situated in the at least one recess. A "recess" should in particular be understood to be a cavity and/or a region that at least has a material thickness along a radial direction of the impact mechanism housing that is less than a material thickness outside the cavity and/or the region of the impact mechanism housing. Basically, the expression "at least one" should be understood to mean that more than one recess can be provided; in an embodiment according to the invention, preferably two recesses and particularly preferably, three recesses, are provided in the impact mechanism housing. Through a corresponding embodiment, the damping device can be accommodated in a particularly advantageous fashion in the at least one recess. It is thus advantageously possible for the damping device to be protected in particular from being damaged by removed material, e.g. chunks of stone.

The at least one recess advantageously extends essentially parallel to the main extension direction of the impact mechanism device. The expression "essentially parallel" here should in particular be understood to be a direction that deviates from a reference direction in particular by less than 8°, advantageously by less than 5°, and particularly advantageously by less than 2°. By means of this embodiment, it is possible to achieve a particularly simple production of the at least one recess in the impact mechanism housing and an advantageous adaptation of the at least one recess to the damping device.

According to another proposal, the at least one recess is situated outside an internal cross-section of the impact mechanism housing in a radial direction of the impact mechanism device. The expression "an internal cross-section of the impact mechanism housing" here should in particular be understood to be a region or a cross-section of the impact mechanism housing that is constituted by a recess in the impact mechanism housing, which is in particular provided to accommodate the guide element. The internal cross-section is preferably embodied as circular, but can also have any other shape deemed suitable by the person skilled in the art. The expression "radial direction" here in particular describes a direction that extends perpendicular to the main extension direction of the impact mechanism device and in particular, extends in the direction of a radius of the internal cross-section of the impact mechanism housing. The at least one recess can be embodied as open toward the outside or can be embodied as at least partially or completely closed by an additional component, which is embodied as a separate component or is embodied as a component that is of one piece with the impact mechanism housing. This can achieve the advantage that the at least one recess can be implemented in a structurally simple fashion. In addition, an advantageous separation of the damping device and the guide element, in particular the pot piston, can be achieved, particularly if the at least one recess is situated in a housing wall of the impact mechanism housing in such a way that a spatial portion or region of the housing wall of the impact mechanism housing is left remaining between the at least one recess and the guide element.

Preferably, the damping device includes at least one damping element, which at least two side walls of the at least one recess cover by at least 50% in a radial direction of the impact mechanism device in order to protect it. The term "damping element" here should in particular be understood to describe a spring-elastic element such as an elastomer, a helical spring, a disk spring, and/or other spring-elastic elements deemed suitable by the person skilled in the art. The damping element can also be composed of a plurality of components with different damping properties. In the embodiment according to the invention, the at least two side walls can cover in particular up to at least 50%, advantageously up to at least 75%, and particularly advantageously up to 100% of the damping element. The term "side walls" here should in particular be understood to mean surfaces with a surface normal vector which extends essentially perpendicular or parallel to the main extension direction. The at least two side walls at least partially delimit the recess. The at least two side walls here are in particular embodied as surfaces that extend continuously in the radial direction of the impact mechanism device, but could also, for example, be embodied in the form of partition walls. The at least two side walls can also be embodied in another form deemed suitable by the person skilled in the art. Preferably, stable side walls can be implemented by means of the continuous surfaces. This makes it possible to achieve a particularly advantageous protection, for example from undesirable soiling and/or undesirable damage of the damping element. In addition, it is possible to achieve a simple assembly of the damping device since it is thus possible to predetermine the position of the damping device in the at least one recess.

Preferably, the damping device is provided between a tool holder and the impact mechanism housing in order to compensate for essentially axial forces. In a particularly advantageous way, the damping device here can be provided between the tool holder and a guide tube, in particular the hammer tube, in order to compensate for essentially axial forces. The term "axial forces" here should in particular be understood to be forces that act on the hammer drill and/or chisel hammer essentially in the axial direction along the main extension direction of the impact mechanism device. As a result, the damping device can advantageously be embodied in a particularly simple way structurally since it essentially compensates for only axial forces. It is therefore possible to use an inexpensive damping device.

According to another proposal, the damping device is provided to damp idle impacts of the impact mechanism device. The term "idle impacts" here should in particular be understood to be an impact of the striking element of the hammer drill and/or chisel hammer in which an impulse transmission to the tool and/or to the impact pin of the hammer drill and/or chisel hammer is preferably interrupted during operation of the hammer drill and/or chisel hammer, in fact, particularly due to the fact that the tool and/or the impact pin is/are situated outside an impact position. This embodiment can achieve the advantage that during an operation of the hammer drill and/or chisel hammer, forces produced by the hammering impulse in an idle impact of the striking element can be absorbed by the damping device. The components of the hammer drill and/or chisel hammer can be protected from damage during the idle impact of the striking element and an advantageously long service life of the parts can be achieved.

The damping device is advantageously at least partially composed of a fastening device. The term "fastening device" is in particular intended to define a device that includes at least one fastening element and is preferably provided to fasten at least one component to at least one other component. Advantageously, the fastening device is provided to fasten the damping device or components of the damping device to the impact mechanism housing and/or to support it or them on the impact mechanism housing. In a particularly preferred embodiment, the fastening device is at least partially composed of at least one component of the damping device. This makes it possible to achieve advantageous savings with regard to additional components, installation space, assembly complexity, and costs.

In particular, the invention proposes a hammer drill and/or chisel hammer with a tool holder in which the fastening device has at least one first fastening element that is provided to connect at least the tool holder to the impact mechanism housing. The term "tool holder" here should in particular be understood to be the region of the hammer drill and/or chisel hammer that has its maximum axial expanse along the main extension direction of the impact mechanism device and is provided to accommodate and axially guide a tool. The tool holder is also advantageously provided to accommodate and axially guide the impact pin of the hammer drill and/or chisel hammer in a region oriented toward the impact mechanism housing. The term "fastening element" is intended to define a component or element such as a screw, a bolt, a nut, etc. that is provided to fasten a component or element in a way deemed suitable by the person skilled in the art. This can achieve the advantage that it is possible to eliminate additional components for fastening the tool holder to the impact mechanism housing, thus making it possible to reduce costs, e.g. for a separate fastening device apart from a damping device. This likewise makes it possible to keep the hammer drill and/or chisel hammer compact.

According to another proposal, the fastening device has at least one first fastening element and the first fastening element is provided to at least partially guide at least one damping element of the damping device. It is consequently possible to eliminate an additional guide element for the damping element, permitting the damping device to be kept particularly compact.

In an assembly procedure, it can also be advantageous for the first fastening element to be guided at least essentially along the main extension direction of the impact mechanism device through a tool holder, an intermediate flange, and the impact mechanism housing, and into the at least one recess. The term "intermediate flange" here should in particular be understood to be a component that is preferably situated between the tool holder and the impact mechanism housing or the guide element and preferably borders the impact mechanism housing along the main extension direction of the impact mechanism device in the direction toward the tool holder; in particular, the guide element can be supported against the intermediate flange along the main extension direction of the impact mechanism device in the direction toward the tool holder. Advantageously, the intermediate flange is in particular provided to constitute a stop for the striking element during an idle impact. The intermediate flange can also be embodied to be of one piece with a housing. This embodiment according to the invention makes it possible to eliminate an additional assembly step for fastening the tool holder, the intermediate flange, and the impact mechanism housing, thus advantageously saving assembly time.

The fastening device preferably has at least one first fastening element and at least one second fastening element; the second fastening element is situated in at least one recess of the impact mechanism housing and is provided at least to accommodate a first fastening element. It is thus possible to eliminate additional components for fastening the first fastening element and to achieve a structurally simple securing of the first fastening element.

The second fastening element is advantageously situated in the at least one recess of the impact mechanism housing in front of the first fastening element at least essentially along the main extension direction of the impact mechanism device and is provided to at least partially limit a movement of the damping element. It is thus possible to advantageously achieve savings on installation space and to keep the damping device advantageously compact.

According to another proposal, at least the first fastening element is provided to prestress the damping device. This advantageous embodiment achieves the advantage that the damping device can be adapted in a particularly flexible, structurally simple way to different working conditions of the hammer drill and/or chisel hammer.

BRIEF DESCRIPTION OF THE DRAWINGS

Other advantages ensue from the following description of the drawings. The drawings show an exemplary embodiment of the invention. The drawings, the description, and the claims contain numerous defining characteristics in combination. The person skilled in the art will also consider the defining characteristics individually and unite them in other meaningful combinations.

DESCRIPTION OF THE PREFERRED EMBODIMENT

Figure 1:
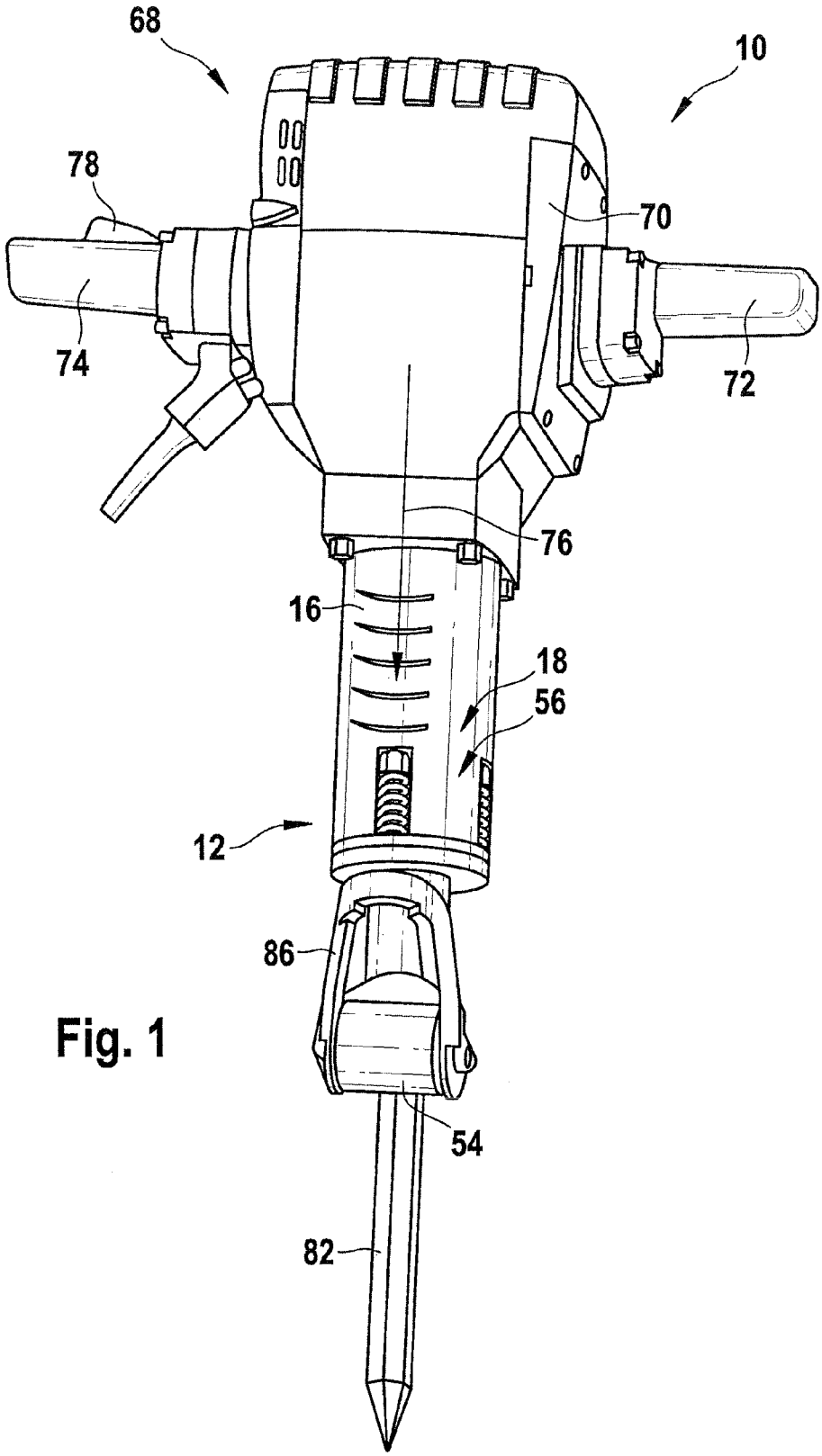
FIG. 1 is a perspective view of a hammer drill and/or chisel hammer.

FIG. 1 shows a hammer drill and/or chisel hammer 10 according to the invention, which is embodied in the form of a demolition hammer 68. The demolition hammer 68 has a motor housing 70, two handles 72, 74, a tool holder 54, and an impact mechanism housing 16 that is of one piece with a guide tube for a piston, which is embodied in the form of a pot piston. The guide tube in this case can be composed of a hammer tube. The motor housing 70 contains a motor unit (not shown in detail here) that is provided to drive an impact mechanism device 12. The two handles 72, 74 are situated on the motor housing 70, extending perpendicular to a main extension direction 76 of the demolition hammer 68. The main extension direction 76 of the demolition hammer 68 extends from the motor housing 70 via the impact mechanism housing 16 in the direction toward the tool holder 54. One of the two handles 72, 74 is provided with a switch pawl 78 that is provided to permit a user to actuate the demolition hammer 68.

Figure 3:
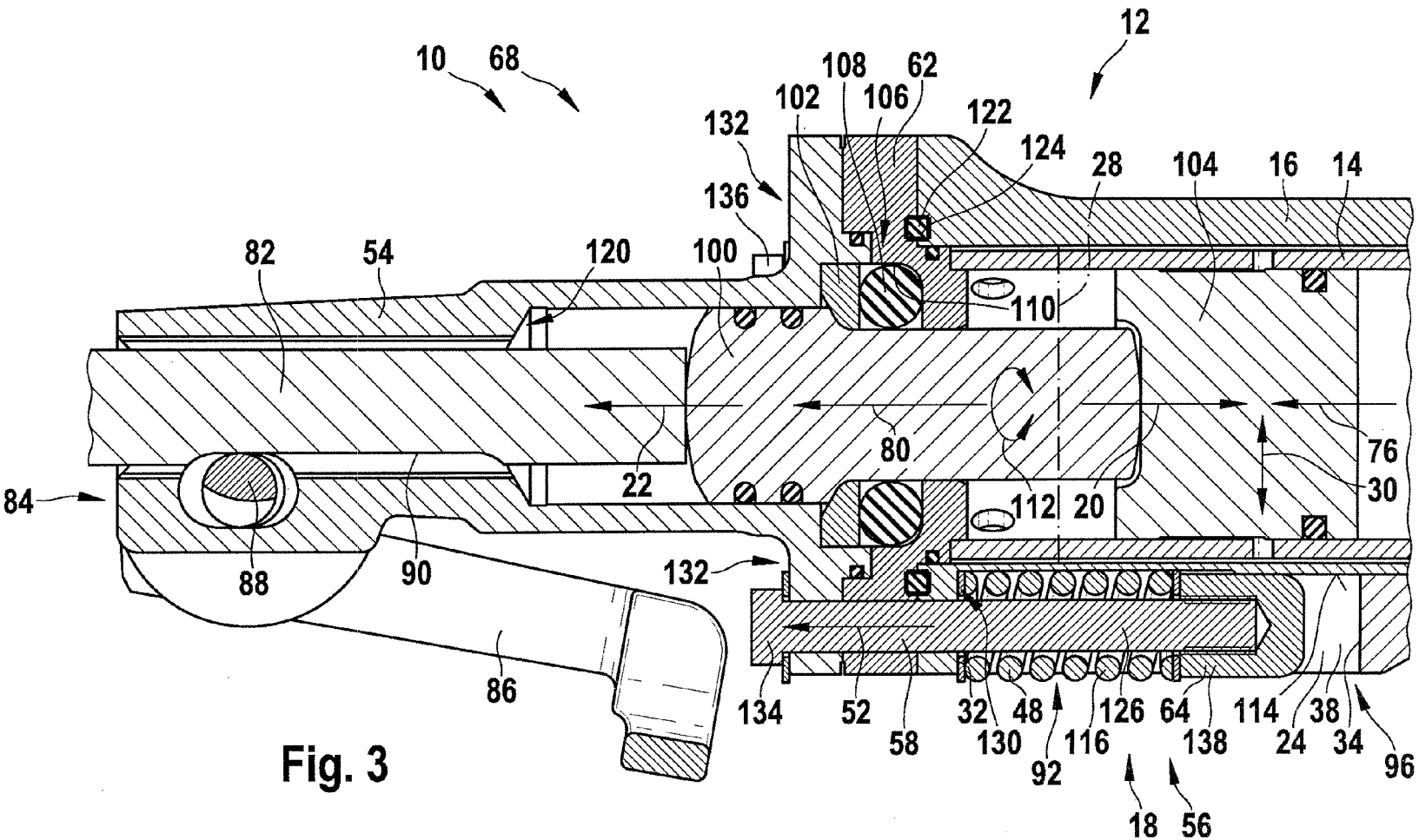
FIG. 3 is a sectional view of the hammer drill and/or chisel hammer in an impact position.
Figure 4:
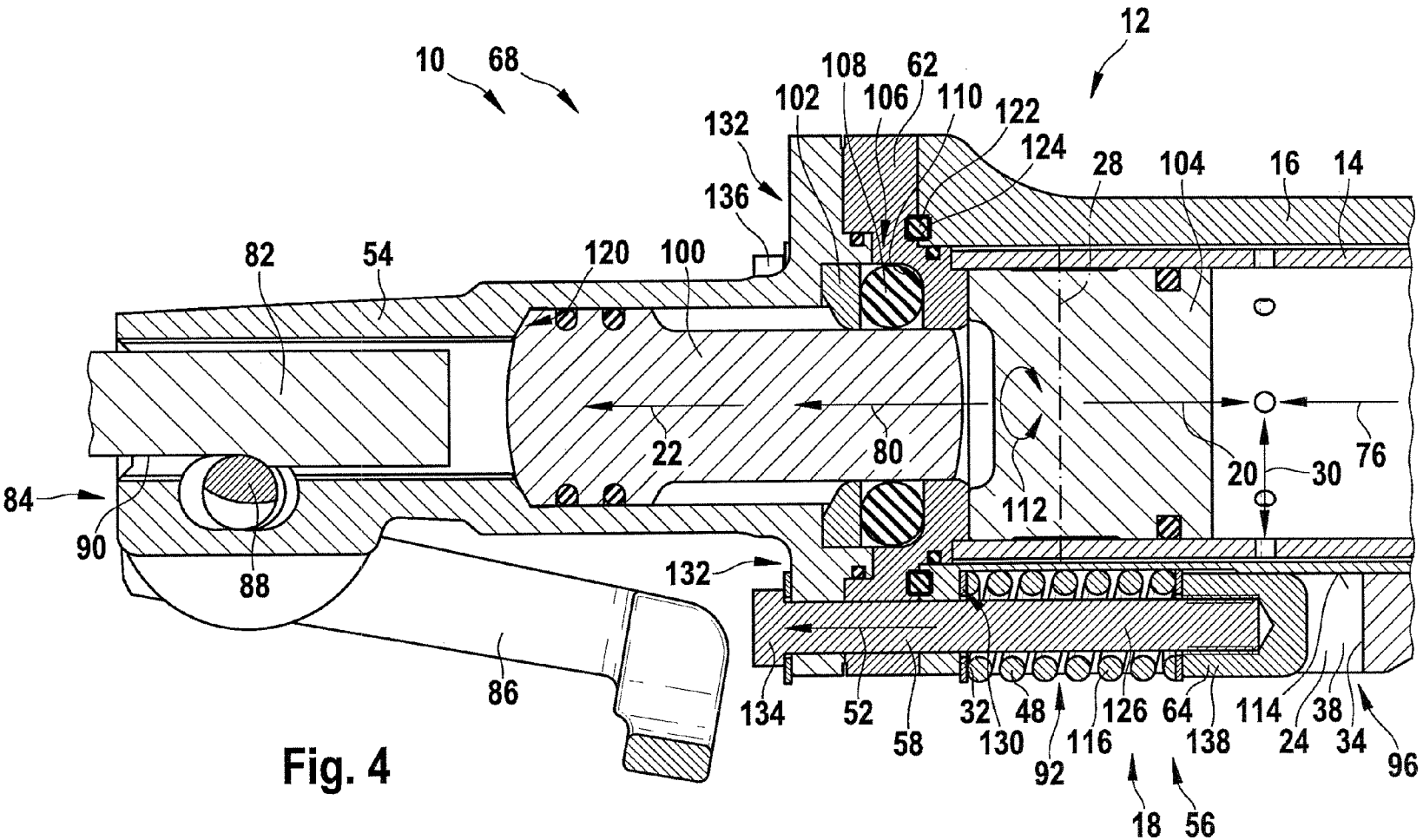
FIG. 4 is a sectional view of the hammer drill and/or chisel hammer in an idle impact position.

The demolition hammer 68 is equipped with the impact mechanism device 12 that includes at least one guide element 14; the impact mechanism housing 16 is situated at least partially around the guide element 14 (also see FIGS. 3 and 4). In addition, the demolition hammer 68 has a damping device 18 that is situated along a main extension direction 20, 22 of the impact mechanism device 12 in an axial region of the impact mechanism housing 16. The main extension direction 20, 22 of the impact mechanism device 12 extends essentially parallel to the main extension direction 76 of the demolition hammer 68. This in turn extends essentially parallel to a main impulse transmission direction 80 of the impact mechanism device 12 to a tool 82 situated in the tool holder 54.

Figure 2:
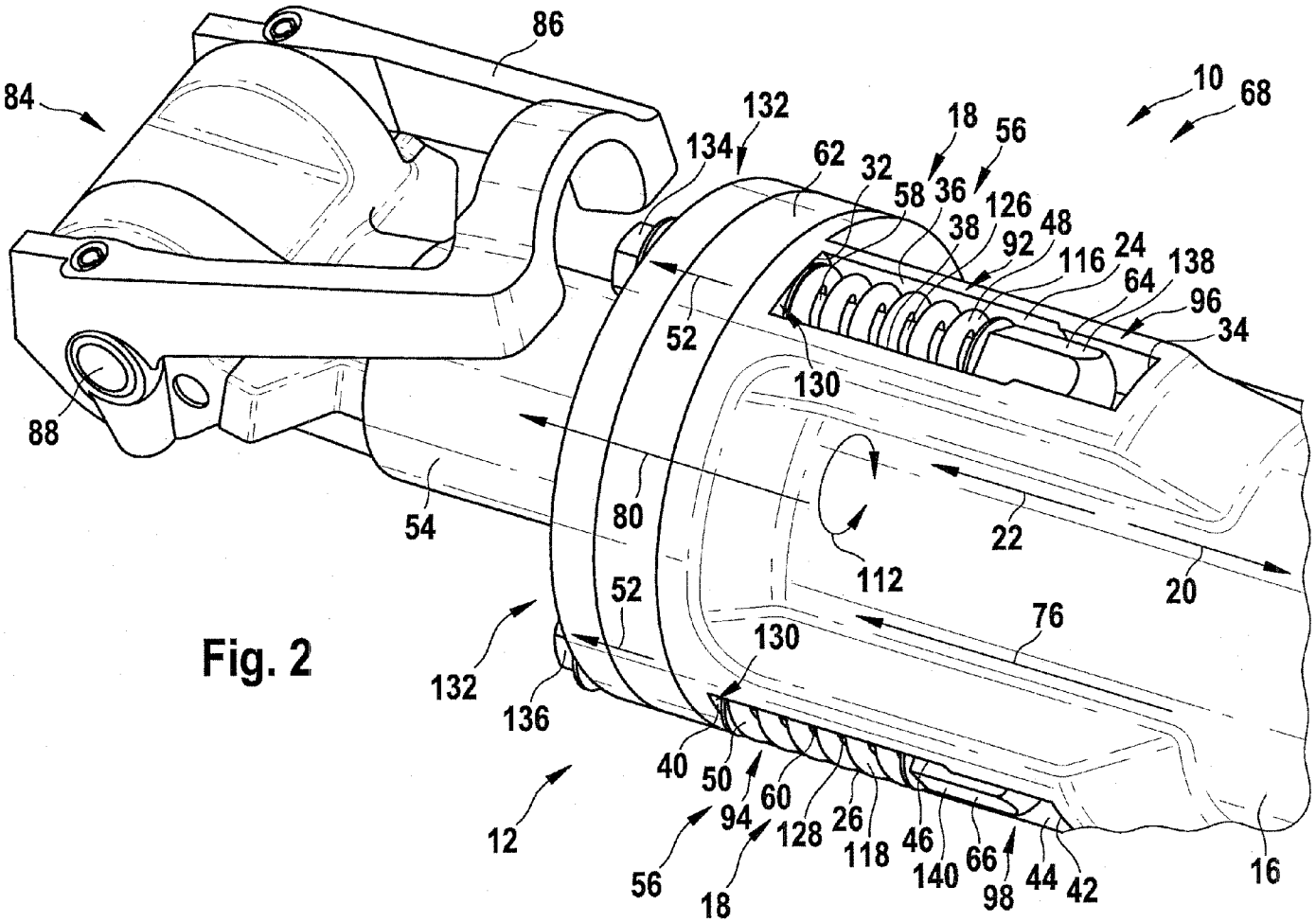
FIG. 2 is a detail view of the hammer drill and/or chisel hammer from FIG. 1.

FIG. 2 shows the tool holder 54 and a part of the impact mechanism housing 16 of the demolition hammer 68. A retaining bracket 86 is situated at an end 84 of the tool holder 54 oriented away from the impact mechanism housing 16 and is provided, when actuated by the user, to radially and/or axially secure the tool 82 in the tool holder 54 by means of a pin 88 that is embodied in the form of a locking pin. For the locking by means of the pin 88, the tool 82 is provided with a groove 90 in which the pin 88 engages in the locking position of the retaining bracket 86. Through the cooperation of the pin 88 and the groove 90, the tool 82 is able to move in the axial direction along the main extension direction 20, 22 of the impact mechanism device 12 (also see FIGS. 3 and 4).

The impact mechanism housing 16 has at least one recess 24, 26 in which a damping device 18 is situated. The number of recesses 24, 26 present in the impact mechanism housing 16 is determined as a function of the application field; in this exemplary embodiment, the number of recesses 24, 26 has been set at three, which are arranged symmetrically around the main extension direction 20, 22 of the impact mechanism device 12. The recesses 24, 26 are embodied so that a region 92, 94 oriented toward the tool holder 54 has a first internal cross-section that is larger than a second internal cross-section of a region 96, 98 of the recesses 24, 26 oriented toward the motor housing 70; a longitudinal span of the region 92, 94 oriented toward the tool holder 54 corresponds to approximately double the longitudinal span of the region 96, 98 oriented toward the motor housing 70. The recesses 24, 26 extend essentially parallel to the main extension direction 20, 22 of the impact mechanism device 12. The first and second internal cross-sections of the recesses 24, 26 extend essentially perpendicular to the main extension direction 20, 22 of the impact mechanism device 12.

FIG. 3 is a schematic depiction of an impact position of the impact mechanism device 12, in a sectional view through the tool holder 54 and a part of the impact mechanism housing 16. In the impact position, the tool 82 is situated in a working position in the tool holder 54 during operation of the demolition hammer 68. In this case, during operation, the user presses the demolition hammer 68 against the surface to be machined so that the tool 82 in the tool holder 84 is slid along the main extension direction 20 of the impact mechanism device 12 in the direction toward the impact mechanism housing 16 and is pressed against an impact means 100 and is thus situated in the working position. This likewise slides the impact means 100 along the main extension direction 20 of the impact mechanism device 12 in the direction toward the impact mechanism housing 16 until the impact means 100 rests against a stop element 102 and a striking element 104. The stop element 102 in this case is embodied in the form of a washer. Basically, the stop element 102 can also be embodied in the form of a different element deemed suitable by the person skilled in the art. The washer is situated in a region 106 of the tool holder 54 oriented toward the impact mechanism housing 16.

In order to damp the impact means 100, a damping element 108 of the impact means 100 is situated in the region 106 of the tool holder 54, after the washer in the direction toward the motor housing 70 along the main extension direction 20 of the impact mechanism device 12. This damping element 108 rests against an intermediate flange 62 that is situated between the tool holder 54 and the impact mechanism housing 16. Preferably, the damping element 108 of the impact means 100 is embodied in the form of an O-ring; it can, however, also be embodied in other ways deemed suitable by the person skilled in the art.

The washer, the damping element 108, and the intermediate flange 62 serve as a stop for the impact means 100 and for this purpose, are situated in an accommodating region constituted by a cavity 110 in the tool holder 54 and the intermediate flange 62. The cavity 110 extends essentially in a circumference direction 112 of the impact mechanism device 12. In the impact position, by means of the motor unit and the striking element 104, a hammering impulse can be imparted via the impact means 100 to the tool 82 contained in the tool holder 54. This occurs in a way that is already known to the person skilled in the art.

The recesses 24, 26 are situated outside an internal cross-section 28 of the impact mechanism housing 16 in a radial direction 30 of the impact mechanism device 12. In addition, the recesses 24, 26 are embodied so that a portion of the impact mechanism housing 16 is left remaining between the guide element 14 and the damping device 18 in the radial direction 30 of the impact mechanism device 12. This prevents a direct contact between the damping device 18 and the guide element 14. The part of the impact mechanism housing 16 that remains constitutes a bottom surface 114 of the recesses 24, 26. The recesses 24, 26 also have four side walls 32, 34, 36, 38, 40, 42, 44, 46 that extend essentially parallel to the radial direction 30 of the impact mechanism device 12 on the impact mechanism housing 16. In this case, two of the four side walls 32, 34, 40, 42 extend essentially parallel along the main extension direction 76 of the demolition hammer 68 and two of the four side walls 36, 38, 44, 46 extend essentially parallel along the circumference direction 112 of the impact mechanism device 12.

The four side walls 32, 34, 36, 38, 40, 42, 44, 46 are provided to advantageously accommodate at least one element of the damping device 18 in a respective recess 24, 26. Basically, the number of side walls 32, 34, 36, 38, 40, 42, 44, 46 can vary in accordance with the embodiment of the recesses 24, 26. The damping device 18 has three damping elements 48, 50, which the side walls 32, 34, 36, 38, 40, 42, 44, 46 of the recesses 24, 26 cover up to at least 75%, particularly advantageously up to approximately 90%, in the radial direction 30 of the impact mechanism device 12 in order to protect them. The damping elements 48, 50 here are embodied in the form of compression springs 116, 118 constituted by helical springs, but they can also be embodied in any other form deemed suitable by the person skilled in the art. Two of the four side walls 32, 34, 36, 38, 40, 42, 44, 46 of the recesses 24, 26 extend along the compression springs 116, 118 of the damping device 18 in the main extension direction 20, 22 of the impact mechanism device 12 and two of the four side walls 32, 34, 36, 38, 40, 42, 44, 46 of the recesses 24, 26 extend along the circumference direction 112 of the impact mechanism device 12. Consequently, the side walls 32, 34, 36, 38, 40, 42, 44, 46 encompass the compression springs 116, 118 in the main extension direction 20, 22 of the impact mechanism device 12 and in the circumference direction 112 of the impact mechanism device 12 (see FIGS. 2 through 4).

FIG. 4 is a schematic depiction of an idle impact position of the impact mechanism device 12 in a section through the tool holder 54 and part of the impact mechanism housing 16. In an idle impact position, the user lifts the demolition hammer 68 up from the surface to be machined during operation. As a result, the tool 82 is situated in an idle position during operation of the demolition hammer 68. In the idle impact position, the impact means 100 is likewise situated in an idle position and rests against a region 120 of the tool holder 54 that tapers along the main extension direction 22 of the impact mechanism device 12 in the direction toward the tool 82. As a result, the impact means 100 is situated beyond reach of the striking element 104 and an impulse transmission from the striking element 104 to the impact means 100 is prevented. The striking element 104 is axially guided in the guide element 14 and is equipped with an idle impact damping that makes it possible to prevent idle impacts of the striking element 104 during operation. This occurs in a way that is already known to the person skilled in the art.

To avoid undesirable idle impacts, particularly at the beginning of an idle impact operation, the damping device 18 is provided to compensate for idle impacts of the striking element 104. This is achieved in that the compression springs 116, 118 are situated in the recess 24, 26 in such a way that they are able to absorb essentially axial forces 52 between the guide element 14 and the tool holder 54 and/or intermediate flange 62. In an idle impact of the striking element 104, the latter can act on the intermediate flange 62 and/or the tool holder 54 with a hammering impulse in the direction toward the tool holder 54 along the main extension direction 22 of the impact mechanism device 12. With this idle impact, the hammering impulse transmitted to the intermediate flange 62 and/or to the tool holder 54 can be advantageously absorbed by the damping device 18 and a transmission to the impact mechanism housing 16 and/or the guide element 14 and/or the user can be at least reduced. The damping device 18 permits the intermediate flange 62 and the tool holder 54 to move in the direction toward the tool holder 54 along a main extension direction 22 of the impact mechanism device 12 and back again in order to thus convert the hammering impulse into a movement impulse. After the idle impact of the striking element 104, the damping device 18 moves the intermediate flange 62 and the tool holder 54 back in the direction toward the motor housing 70 along the main extension direction 20 of the impact mechanism device 12.

In order to damp an impact of the intermediate flange 62 against the impact mechanism housing 16 and/or the guide element 14 during a movement that the damping device 18 causes in the direction toward the motor housing 70 along the main extension direction 20 of the impact mechanism device 12, another damping element 122 is provided, which can be advantageously embodied in the form of a damping element 122 with a square cross-section, e.g. a Kantseal. It can also come in any other shape deemed suitable by the person skilled in the art, e.g. an O-ring. The damping element 122 is situated in a groove 124 that extends partly in the impact mechanism housing 16 and partly in the intermediate flange 62. The groove 124 extends along the circumference direction 112 of the impact mechanism device 12 and its cross-section essentially corresponds to the shape of the damping element 122.

The damping device 18 is at least partially composed of a fastening device 56 that has three first fastening elements 58, 60 that are provided for connecting the tool holder 54 to the guide element 14 and the impact mechanism housing 16 via the intermediate flange 62. To accomplish this, in an assembly procedure, the first fastening elements 58, 60 each extend at least essentially along the main extension direction 20 of the impact mechanism device 12, through the tool holder 54, the intermediate flange 62, and the impact mechanism housing 16, and into a respective recess 24, 26. In this embodiment of the demolition hammer 68 according to the invention, the first fastening elements 58, 60 are embodied in the form of screws 126, 128. The first fastening elements 58, 60 can, however, also be embodied in any other form deemed suitable by the person skilled in the art. The screws 126, 128 serve to guide the compression springs 116, 118 of the damping device 18 in the recesses 24, 26.

A washer is inserted into each of the recesses 24, 26 at an end 130 oriented toward the tool holder 54 and rests against the impact mechanism housing 16. The compression springs 116, 118 and then a respective additional washer are situated after the washers in the recesses 24, 26 in the direction toward the motor housing 70 along the main extension direction 20 of the impact mechanism device 12. In lieu of the washers, it is also possible to use disk springs and/or other components deemed suitable by the person skilled in the art. The compression springs 116, 118 and the washers are situated essentially in the region 92, 94 of the recesses 24, 26 oriented toward the tool holder 54 and are guided on the screws 126, 128. At their end 132 oriented toward the tool holder 54, the screws are each equipped with a respective screw head 134, 136. A washer is provided between the screw head 134, 136 and the tool holder 54 and serves to improve the force distribution of the screw 126, 128 or more precisely stated, the screw head 134, 136, in relation to the tool holder 54.

A second fastening element 64, 66 of the fastening device 56 is inserted into the recesses 24, 26 and is provided to accommodate the screws 126, 128. In this case, the second fastening element 64, 66 is embodied in the form of a cap nut 138, 140, but can also be embodied in any other form deemed suitable by the person skilled in the art. The cap nuts 138, 140 are contained in a form-locked fashion with a slight amount of play, essentially in the region 96, 98 of the recesses 24, 26 oriented toward the motor housing 70. Consequently, the cap nuts 138, 140 are situated in the recesses 24, 26 in front of the screws 126, 128, viewed from the motor housing 70 along the main extension direction 22 of the impact mechanism device 12 in the direction toward the tool holder 54. The cap nuts 138, 140 are situated so that they are each able to move inside the respective recess 24, 26, in the axial direction along the main extension direction 20, 22 of the impact mechanism device 12. The cap nuts 138, 140 therefore serve as an at least partial limitation for the compression springs 116, 118 of the damping device 18 along the main extension direction 20 of the impact mechanism device 12.

The screws 126, 128 can be used to prestress the damping device 18 and the damping device 18 can be adapted to corresponding working conditions during or preferably before operation of the demolition hammer 68. The cap nuts 138, 140 rest against the washers, which are situated after the compression springs 116, 118 in the direction toward the motor housing 70 along the main extension direction 20 of the impact mechanism device 12, so that the compression springs 116, 118 of the damping device 18 can be compressed along the main extension direction 22 of the impact mechanism device 12 in opposition to a spring force by screwing the screws 126, 128 into the cap nuts 138, 140, thus making it possible to prestress the compression springs.

The foregoing relates to the preferred exemplary embodiment of the invention, it being understood that other variants and embodiments thereof are possible within the spirit and scope of the invention, the latter being defined by the appended claims.

The invention claimed is:

1. A hammer drill and/or chisel hammer, comprising:

an impact mechanism housing;

an impact mechanism device disposed in the impact mechanism housing;

a tool holder; and at least one damping device, including at least one damping element disposed between said impact mechanism housing and said tool holder and situated along a main extension direction of the impact mechanism device on the impact mechanism housing, said at least one damping device at least partially constituted by a fastening device configured to fasten said tool holder to said impact mechanism housing and having at least one first fastening element provided to at least partially guide said at least one damping element, and at least one second fastening element, separate from said housing and said first fastening element, connected to said first fastening element and configured to compress said at least one damping element, wherein the least one first fastening element is situated in at least one recess defined in the impact mechanism housing which recess is provided to at least accommodate the at least one first fastening element, and wherein the second fastening element is situated in the at least one recess of the impact mechanism housing, in front of the first fastening element at least essentially along the main extension direction of the impact mechanism device, and the second fastening element is provided to at least partially limit a movement of a damping element of the damping device.

2. The hammer drill and/or chisel hammer as recited in claim 1, wherein the damping device is at least partially situated in the at least one recess.

3. The hammer drill and/or chisel hammer as recited in claim 2, wherein the at least one recess extends essentially parallel to the main extension direction of the impact mechanism device.

4. The hammer drill and/or chisel hammer as recited in claim 2, wherein the at least one recess is situated outside an internal cross-section of the impact mechanism housing in a radial direction of the impact mechanism device.

5. The hammer drill and/or chisel hammer as recited in claim 2, wherein in an assembly procedure, the first fastening element is guided at least essentially along the main extension direction of the impact mechanism device, through the tool holder, an intermediate flange, and the impact mechanism housing, and into the at least one recess.

6. The hammer drill and/or chisel hammer as recited in claim 1, wherein at least the fastening device is configured to prestress the damping device.

7. A hammer drill and/or chisel hammer, comprising:

an impact mechanism housing;

an impact mechanism device disposed in the impact mechanism housing; and at least one damping device, which is situated along a main extension direction of the impact mechanism device on the impact mechanism housing and which is at least partially constituted by a fastening device, wherein the damping device has at least one damping element and at least one recess which has at least two side walls that are parallel to the main extension direction of the impact mechanism and that cover the at least one damping element by at least 50% in a radial direction of the impact mechanism device in order to protect the damping element, wherein the fastening device includes;

at least one first fastening element situated in the at least one recess; and a second fastening element situated in the at least one recess in front of the first fastening element at least essentially along the main extension direction of the impact mechanism device, the second fastening element configured to at least partially limit a movement of a damping element of the damping device.

8. The hammer drill and/or chisel hammer as recited in claim 7, further comprising a tool holder in which the damping device is provided between the tool holder and the impact mechanism housing in order to compensate for essentially axial forces.

9. The hammer drill and/or chisel hammer as recited in claim 7, further comprising a tool holder, wherein the at least one first fastening element is configured to connect at least the tool holder to the impact mechanism housing.

10. The hammer drill and/or chisel hammer as recited in claim 7, wherein the at least one first fastening element is configured to at least partially guide at least one damping element of the damping device.

11. The hammer drill and/or chisel hammer as recited in claim 10, wherein in an assembly procedure, the first fastening element is guided at least essentially along the main extension direction of the impact mechanism device, through a tool holder, an intermediate flange, and the impact mechanism housing, and into at least one recess defined in said impact mechanism housing.

12. The hammer drill and/or chisel hammer as recited in claim 10, wherein at least the fastening device is configured to prestress the damping device.

* * * * *

UNITED STATES PATENT AND TRADEMARK OFFICE

CERTIFICATE OF CORRECTION

PATENT NO. : 8,695,723 B2
APPLICATION NO. : 12/994676
DATED : April 15, 2014
INVENTOR(S) : Werner et al.

It is certified that error appears in the above-identified patent and that said Letters Patent is hereby corrected as shown below:

On the title page, item (56), the listing of foreign patent documents should be updated as follows:

FOREIGN PATENT DOCUMENTS

| | | | |
|---|---|---|---|
| BE | 524086 | A | 11/1953 |
| DE | 1300475 | B | 7/1969 |
| DE | 6950059 | U | 6/1971 |
| DD | 120611 | A1 | 6/1976 |
| GB | 2234464 | A | 2/1991 |
| HU | 185749 | B | 3/1985 |

Signed and Sealed this
Eleventh Day of November, 2014

Michelle K. Lee

Michelle K. Lee
*Deputy Director of the United States Patent and Trademark Office*